United States Patent [19]

Sehorn

[11] Patent Number: 4,635,640

[45] Date of Patent: Jan. 13, 1987

[54] LADIES COMPETITION SUIT

[76] Inventor: Rhonda Sehorn, 4024 S. Lynn, Independence, Mo. 64055

[21] Appl. No.: 743,101

[22] Filed: Jun. 10, 1985

[51] Int. Cl.[4] ..... A41C 1/06; A41D 5/00

[52] U.S. Cl. ..... 128/438; 2/67

[58] Field of Search ..... 2/67; 128/431, 439, 128/440, 450, 488, 508, 509, 510

[56] References Cited

U.S. PATENT DOCUMENTS

| | | | |
|---|---|---|---|
| 1,865,029 | 6/1932 | Martz . | |
| 1,930,034 | 10/1933 | Bergh | 2/67 |
| 2,022,317 | 11/1935 | Kemp | 128/509 |
| 2,402,835 | 6/1946 | Nagy | 128/509 |
| 2,436,610 | 2/1948 | Saxon | 2/80 |
| 2,626,395 | 1/1953 | Whitman | 2/67 |
| 3,306,299 | 2/1967 | Paramore | 128/505 |
| 3,740,765 | 6/1973 | Delplace | 2/67 |
| 3,935,865 | 2/1976 | Newmar | 128/509 |

FOREIGN PATENT DOCUMENTS

| | | | |
|---|---|---|---|
| 425948 | 3/1935 | United Kingdom | 2/67 |

OTHER PUBLICATIONS

Joe Weider's *Muscle & Fitness* Magazine, Mar. 1985; Flex Appeal advertisement; Flash Report by Mort D. Arthur.

Joe Weider's *Muscle & Fitness* Magazine, Apr. 1985; Corinna Conquers Canada article by Sheila Herman.

*Primary Examiner*—Doris L. Troutman

*Attorney, Agent, or Firm*—D. A. N. Chase; Michael Yakimo, Jr.

[57] ABSTRACT

A two-piece competition suit for use by a woman body builder comprising brief and bra members with a cord member interconnecting the same. The cord cooperates with ring members on the brief so as to variously size the suit and allow the brief to respond to changes in size and/or musculature of the woman body builder.

8 Claims, 5 Drawing Figures

LADIES COMPETITION SUIT

BACKGROUND OF THE INVENTION

This invention relates to athletic wear and more particularly to a competition suit for a woman body builder.

The sport of women body building is a burgeoning one. With the acceptance of the "ripped" female body, women body builders can now strive to achieve optimal, symmetrical musculature.

The overall appearance of the competitor is important to successful competition. Elements, contributing to such appearance, include the body musculature, the "posing" routine and the appearance and "fit" of the competitor's suit. As such, the competition suits are necessarily of the two-piece, bikini style so as to optimally display the competitor's overall physique. These suits preferrably have a high leg cut which enables the suit to ride high on the competitor's hips and optimally display the muscles of the lower torso.

It is also preferred that the top piece/bra be connected to the bottom piece/brief. Otherwise, the brief may roll down the hips of the competitor during posing. Accordingly, strings are utilized which connect the brief to the bra with the string ends being knotted on the back or the neck of the user. The use of strings, extending between the brief and bra, is preferred as it is believed to enhance the V-shaped appearance of the posterior, upper torso of the wearer. A suit which utilizes a bra strap traversing the posterior, upper torso is believed to degrade the desired V-shape appearance thereof.

Heretofore, the front panel of the brief has been connected with the back panel of the brief by either a fixed integral band of material extending between the anterior and posterior panels and across the hip lines. To achieve an optimal display of the hip line, strings have been used in place of the material bands. The competitor must knot the lower ends of the vertically extending strings to the brief or the material/strings extending between the front and rear panels thereof. This arrangement presents unsightly ties and/or knots on the hip lines which detracts from the overall appearance of the body builder during posing. Also, the panel strings must be knotted which presents unsightly ties and/or knots.

Other than the inherent resiliency of the utilized material, this type of "fixed" panel connection renders the brief non-responsive to flexure of the muscles during posing. Also, such a "fixed" suit cannot respond to the various changes in body weight and/or musculature of the competitor which normally arise between competitions. This past construction delimits the ability of the competitor to utilize a single suit which properly "fits" her changing sizes.

In response thereto, I have invented a competition suit which utilizes a novel method of maintaining the bikini brief on the competitor which eliminates the appearance of unsightly ties, knots and horizontally traversing bands as found in prior competition suits. Moreover, my brief responds to the contractions of the surrounding muscles and is thus not hindered by the "fixation" of the connecting material/strings extending between the front/anterior and rear/posterior panels and across the hips of the wearer. Furthermore, my novel competition suit can be worn by the user despite her changes in sizes between competitive events. Accordingly, my suit alleviates the need for the user to buy variously sized suits for non-competition activities.

It is therefore a general object of this invention to provide a competition suit for a woman body builder.

It is another general object of this invention to provide a competition swimsuit, as aforesaid, which presents a proper fit to the various sizes of a single body builder who may change in size between competitive events.

Another particular object of this invention is to provide a two-piece competition suit, as aforesaid, having novel means for variously sizing the brief and maintaining the brief in place on the woman body builder.

Still another object of this invention is to provide a competition suit with brief, as aforesaid, which responds to the dynamic changes in musculature of a posing woman body builder.

Another particular object of this invention is to provide a competition suit, as aforesaid, which enhances the overall appearance of the competitive woman body builder.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
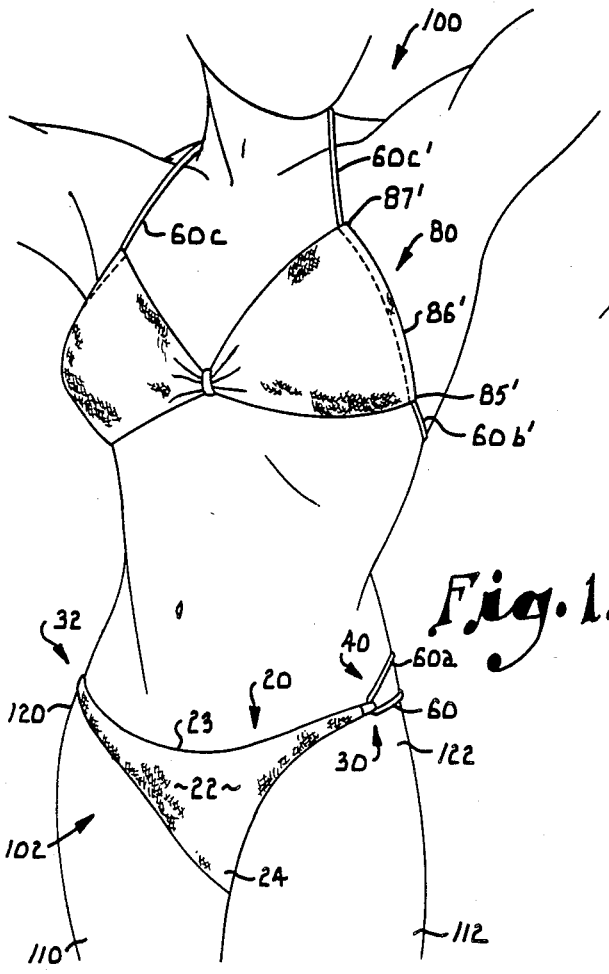
FIG. 1 is a front view showing the competition suit in place on a body builder.

Turning more particularly to the drawings, FIGS. 1–4 illustrate my suit 10 in place on a posing woman body builder 100. My suit is two-piece in construction so as to optimally display the overall musculature of the competitor 100. As such, the competition suit 10 generally comprises a brief member 20 for covering the anterior 102 and posterior 104 pelvic regions of the wearer 100 and a brassiere member 80.

The brief member 20 generally comprises an integral front panel 22 and rear panel 26 with a crotch panel 24 extending therebetween. The opposed panels 22, 26 present high cut edges 23, 27 which optimally enhance and display the overall musculature of the competitor's legs 110, 112 and hip regions 120, 122.

Figure 3:
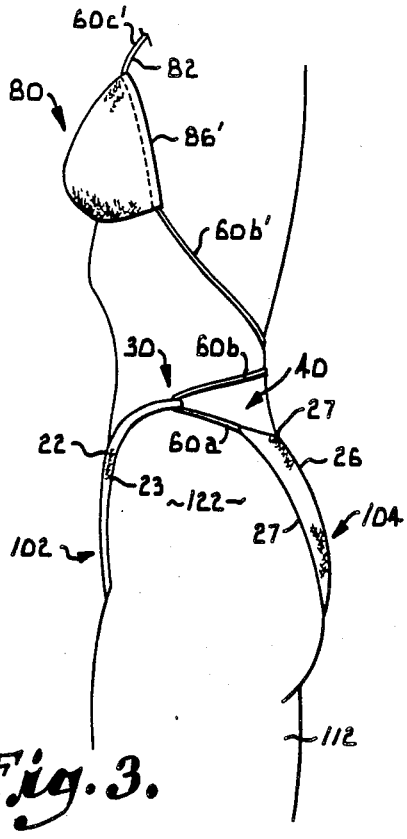
FIG. 3 is a side elevation view of the suit in a first position on a body builder of a first size or musculature.
Figure 4:
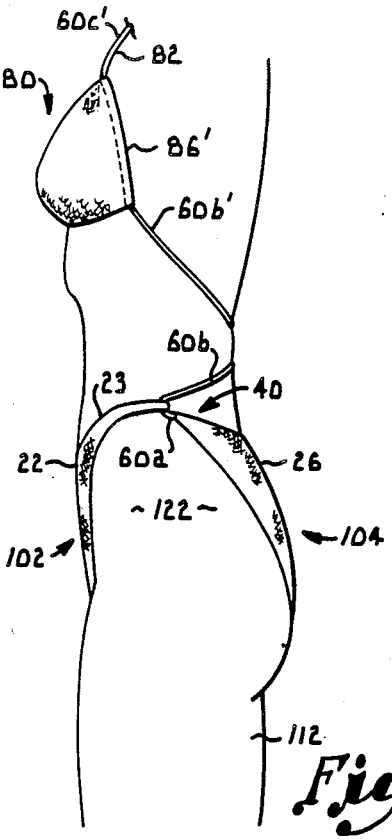
FIG. 4 is a side elevation view of the suit in a second position on a body builder of a second size or musculature.
Figure 5:
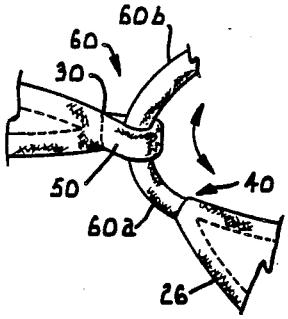
FIG. 5 is a fragmentary, perspective view showing the ring/cord combination associated with the brief of the competition suit illustrated in FIG. 1.

As shown, the laterally spaced-apart ends 30, 32 of the top edge 23 of the front panel 22 terminate on the respective hip 120, 122 areas. It is understood that FIGS. 3 and 4 illustrate my suit 10 on the left hip 122 of the wearer 100 and that identical structure appears on the right hip 120 thereof.

Figure 2:
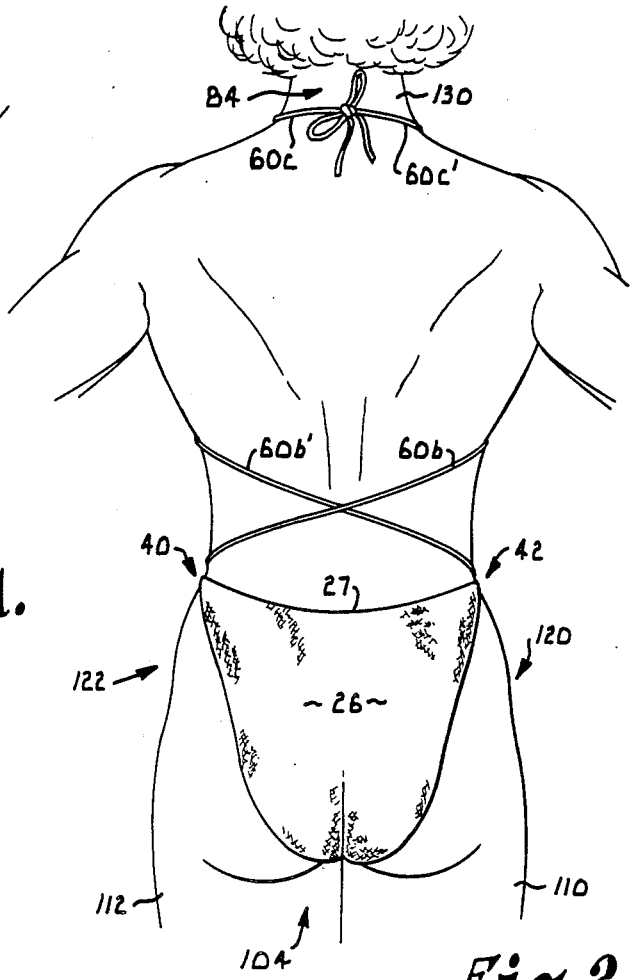
FIG. 2 is a rear view of the illustration in FIG. 1.

As best shown in FIG. 2, the rear panel 26 overlies the posterior 104 region/gluteal muscles of the wearer 100. The rear panel 26 has a top edge 27 which terminates in laterally spaced-apart ends 40, 42 on the opposed hips 120, 122 of the wearer 100.

Prior to my suit 10, the front panel 22 has been fixedly joined with the ends 40, 42 of rear panel 26. Integral bands, straps and cords, extending between such panels 22, 26 and across the hip regions 120, 122, have been used to provide such fixation. Aside from the inherent resiliency of the material utilized, the connection of the front panel 22 to the rear panel 26 has been a "fixed" one. Thus, a proper fit of the brief 20 about the respective regions 102, 104 and hips 120, 122 of the competitor 100 has been necessarily dependent on utilizing a properly sized brief 20 according to the particular size of the woman body builder at the time of fitting. This "fixed" sizing of the brief 20 is not responsive to changes in the musculature of the competitor 100, particularly the pelvic regions 102, 104. Such changes may be due to a weight and/or musculature gain/loss of the competitor 100 or the controlled contraction of the muscles by the competitor 100 during posing.

In response thereto, I provide means for selectably and variously adjusting the relationship between the front panel 22 and the rear panel 26 so that the brief 20 may be variously "sized" and/or be responsive to changes in musculature. This means is presented by a ring member 50 which extends from the free ends 30, 32 of the front panel 22 of the brief 20 and towards the posterior 104 region of the body builder upon positioning the front 22 panel contiguous to the anterior pelvic region 102. Ring 50 receives a cord, generally designated as 60, in slidable, back and forth extension therethrough. The cord 60 is illustrated as having integral segments 60*a*, 60*b* and 60*c*. The portions of the ring 50/cord 60 combination on the right hip 120 are given identical, primed numbers where shown. The cord segment 60*a* extends from the free end 40 of the rear panel 26 and through the overlying ring 50. After passage through the ring 50, cord segment 60*b* extends diagonally across the back muscles of the competitor 100 for extension through a channel 86, 86' diagonally extending along the lateral sides of the bra 80. As such, the bra 80 is slidable along the segments 60*b* and 60*b'* such that the vertical displacment between the brief 20 and bra 80 is user selectable. Upon exit from the respective channels 86, 86', cord segments 60*c*, 60*c'* are respectively presented which are then tied about the neck 130 of the wearer 100 and knotted (FIG. 2) at the posterior region thereof.

In use the suit 10 is positioned on the wearer 100 such that the front panel 22 overlies the front pelvic region 102 and the rear panel 26 overlies the posterior region 104 of the wearer 100. The cord member 60 is then drawn through the ring 50 until a user-selectable fit of the brief 20 about the wearer 100 is achieved. As shown in FIG. 4, this arrangement allows for a user-selectable displacement between the front panel 22 and the rear panel 26. This displacement presents a cord segment 60*a* extending between the end 40 of rear panel 26 and ring 50 and a segment 60*b* extending from the ring 50 to the point of entry into the channel 86 of bra 80. Once the brief 20 is fitted, the bra 80 is adjusted by slidable movement of the channels 86, 86' along the respective cord segments 60*b*, 60*b'* until the desired fit is achieved. Once positioned, the cord segments 60*c*, 60*c'*, exiting from the channels 86, 86', are knotted 84 about the neck 130 so as to maintain the bra 80 on the wearer.

During posing, controlled contraction of the muscles, associated with the regions 102, 104, necessarily presents a larger size to the brief 20 which urges the rear panel 26 away from the front panel 22. The ring 50/cord 60 combination responds to such contractions by allowing the length of the respective segments 60*a*, 60*a'* to increase. After such contractions, segments 60*a*, 60*a'* can then return to their original length/position. Also, this ring 50/cord 60 combination responds to contraction of the back muscles by allowing the length of the segments 60*b*, 60*b'* to increase which shortens the length of segments 60*a*, 60*a'*. These actions responsively occur, as the cord 60, 60' segments are responsively slidable through their respective rings 50, 50'.

Accordingly, my suit 10, as above-described, is responsive to such muscle movement as provided by the cooperation of the ring 50 and cord segments. It is understood that the illustrated lengths of the cord segments in FIGS. 3 and 4 are for purposes of illustration and that the measured slidable movement of the cord 60 through ring 50 depends upon the changes in the musculature of the particular user 100.

FIGS. 3 and 4 can alternatively illustrate the relationship between the "competitive" build of the body builder as shown in FIG. 4 and the "post competitive" build as shown in FIG. 3. Normally, the weight and/or muscle size of the body builder changes after competition which requires the use of a differently sized suit (larger as shown). Thus as shown in FIG. 3, the respective cord segments 60*a* are easily lengthened to increase the displacement between the front 22 and rear 26 panels which presents a larger size brief 20 for wear by the body builder 100. The bra 80, being slidable along the cords 60, is also adjustable in response to the changing back musculature of the back of the body builder 100. Also, the length of cord segments 60*c*, 60*c'* responsively changes according to the changes in the integral, downstream segments 60*b*, 60*b'* and 60*a*, 60*a'*. Accordingly, my single suit 100 allows for a fit on a variously sized body builder.

Also of importance is that my suit 10 eliminates the appearance of the unsightly knots and/or ties along the hip regions 120, 122 of the competitor 100 which detract from the aesthetic appearance of the posing competitor.

It is to be understood that while certain forms of this invention have been illustrated and described, it is not limited thereto, except in so far as such limitations are included in the following claims.

Having thus described the invention, what is claimed as new and desired to be secured by Letters Patent is:

1. A competition suit for a woman comprising:

a bikini brief having a first panel for covering the front pelvic region of the wearer and a rear panel for covering the posterior region of the wearer, said front and rear panels being connected by a crotch panel therebetween;

a bra member;

means for maintaining said bra on said wearer;

a pair of laterally spaced-apart female fastener elements connected to one of said front or rear panels and positioned on the respective hips of the wearer;

a pair of laterally spaced-apart elongated male fastener elements connected to the other of said front or rear panels and positioned on the respective hips of the wearer, said respective male elements slidable through said male elements for joining said front panel to said rear panel on said regions of said wearer in a user-selectable displacement therebetween, said male elements further joining said brief with said brassiere, said slidable relationship between said elements allowing for displacement of said front and rear panels towards and away from one another in response to various sizes of said pelvic and posterior regions of said wearer.

2. The apparatus as claimed in claim 2 wherein said male fastener elements comprises a ring element with said female element comprising a cord element, said cord being slidable through said ring to present said movement.

3. The apparatus as claimed in claim 2 wherein said cord is associated with said bra to present said connecting means.

4. The apparatus as claimed in claim 3 wherein said cord includes at least integral first and second segments with said first segment extending between said panel and said ring with said second segment extending between said ring and said bra, said respective segments changing in length to displace said front and rear panel members.

5. The apparatus as claimed in claim 4 wherein said first segment lengthens to increase the displacement between said panels.

6. The apparatus as claimed in claim 4 wherein said first segment shortens to decrease the displacement between said panels.

7. The apparatus as claimed in claim 4 wherein said second segment slidably extends through said bra allowing for user displacement of said bra along said second segment and relative to said brief.

8. The apparatus as claimed in claim 7 further comprising a third integral segement of said cord exiting from said bra and having terminal free ends, said ends being tied about the wearer to provide said means for maintaining said bra on said wearer.

* * * * *

UNITED STATES PATENT AND TRADEMARK OFFICE

CERTIFICATE OF CORRECTION

PATENT NO. : 4,635,640

DATED : January 13, 1987

INVENTOR(S) : RHONDA SEHORN

It is certified that error appears in the above—identified patent and that said Letters Patent is hereby corrected as shown below:

Claim 1, column 4, line 63, delete "male" and insert --female-- therein.

Claim 1, column 4, line 66, delete "joining" and insert --connecting-- therein.

Claim 2, column 5, line 4, delete the numeral "2" and insert --1-- therein.

Claim 2, column 5, line 5, delete "male" and insert --female-- therein.

Claim 2, column 5, line 6, delete "female" and insert --male-- therein.

Claim 3, column 5, line 12, delete "means".

Claim 8, column 6, line 14 delete "segement" and insert --segment-- therein.

Signed and Sealed this

Fifteenth Day of September, 1987

*Attest:*

DONALD J. QUIGG

*Attesting Officer*

*Commissioner of Patents and Trademarks*